United States Patent [19]

Davis

[11] Patent Number: 4,590,841

[45] Date of Patent: May 27, 1986

[54] APPARATUS FOR PRIMING CARTRIDGES

[76] Inventor: Gregory G. Davis, 1630 W. Cris Ave., Anaheim, Calif. 92802

[21] Appl. No.: 689,067

[22] Filed: Jan. 7, 1985

[51] Int. Cl.[4] ..... F42B 33/04; F42B 33/10

[52] U.S. Cl. ..... 86/36; 86/37

[58] Field of Search ..... 86/36, 37, 38, 23, 24, 86/25; 81/3.2, 3.3, 3.37

[56] References Cited

U.S. PATENT DOCUMENTS

| | | | |
|---|---|---|---|
| 735,047 | 8/1903 | Alsop | 86/36 |
| 2,794,359 | 6/1957 | Lyman, III et al. | 86/38 |
| 3,134,293 | 5/1964 | Lee | 86/37 |
| 3,153,977 | 10/1964 | Dicken | 86/38 |
| 3,320,848 | 5/1967 | Ponsness | 86/38 |
| 3,349,663 | 10/1967 | Slee | 86/38 |
| 4,177,711 | 12/1979 | Lee | 86/38 |
| 4,189,980 | 2/1980 | Schaenzer | 86/37 |

*Primary Examiner*—Stephen J. Lechert, Jr.
*Assistant Examiner*—Howard J. Locker
*Attorney, Agent, or Firm*—Francis X. LoJacono

[57] ABSTRACT

The present invention defines a precision primer-reloading assembly to be mounted in and operated by a suitable cartridge-reloading press. The assembly includes a tubular support-body member having a ram rod mounted therein so as to be positioned within the cartridge case at the time the primer is loaded. The support-body member is mounted to the reloading press above and in alignment with a primer-guide assembly which is mounted to the press ram of the reloading press. The guide assembly includes a guide base having a primer-guide pin. A coil spring is positioned on the guide base so as to engage the guide housing that is slidably mounted over the guide base, the guide housing being formed with a closed end having a centrally positioned recess. This recess is provided to support and align the cartridge case with the ram rod, whereby the primer can be loaded in the primer pocket of the case by means of the primer pin as the ram rod is activated. One or more shim members are provided to allow the primer to be selectively positioned at a predetermined location within the primer pocket.

4 Claims, 4 Drawing Figures

APPARATUS FOR PRIMING CARTRIDGES

BACKGROUND OF THE INVENTION

Field of the Invention

This invention relates generally to a device for reloading cartridge cases, and more particularly to a precision primer-reloading assembly designed for use in combination with most cartridge-reloading, press devices.

There is lacking in the art a suitable means for the reloading of a primer in the head of a cartridge case in a consistently precise manner.

Many types of reloading devices are being employed at the present time. However, these devices have features that restrict their use and they do not provide consistent accuracy in reloading a primer, thus making the operation time-consuming. Most of the reloading devices in use are designed to provide a great amount of leverage when forcing a primer into the primer pocket of a case. This added leverage is useful and desirable during full-length resizing. However, this same leverage in itself creates a problem in that it is not often successful for properly seating a primer at its optimum firing position within the primer pocket of the case. This leverage makes feeling a primer bottom a sporty task, but it is not often successful for properly seated primers.

Although co-ax priming overcomes this problem to some degree, there is at present no suitable means to overcome the differences in primer-pocket depths or differences in primer heights which often introduce some placement errors. Ammunition manufacturers are quick to point out that the average handloader does a very poor job of priming cases. It is well established that poor firing of shells is primarily caused by improper positioning of the primer.

SUMMARY AND OBJECTS OF THE INVENTION

The present invention has for an important object to overcome all of the known problems in the art, and to establish a means by which primers can be accurately and consistently inserted and positioned within primer pockets of cartridge-case heads.

Another object of the invention is to provide a precision primer-reloading apparatus that is compatible with most known reloading-press devices.

Still another object of the invention is to provide a precision primer-reloading apparatus which includes a supportbody member arranged to be mounted to a reload-press device and accurately positioned by a lock-nut arrangement. A ram rod is mounted within the support body and arranged to be received within the shell case so as to engage the bottom of the case, thereby securing the case in a vertical position for reloading. A guide assembly is mounted to a typical press ram, the guide assembly including a guide base and a spring member mounted on the base, over which a guide housing is slidably positioned. A shim (or shims) is also provided for depth adjustment of the primer as the primer is loaded in the primer pocket of the case.

A further object of the present invention is to provide a device of this character to allow the primer to be consistently positioned within the primer pocket of the case by using the surface of the case head as a zero point.

It is still another object of the invention to provide a precision primer-reloading device having relatively few operating parts, thus making it easy to assemble, service and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particulary to the accompanying drawings, which are for illustrative purposes only and wherein like numerals are used to identify like elements.

DESCRIPTION OF THE PREFERRED EMBODIMENT

Figure 1:
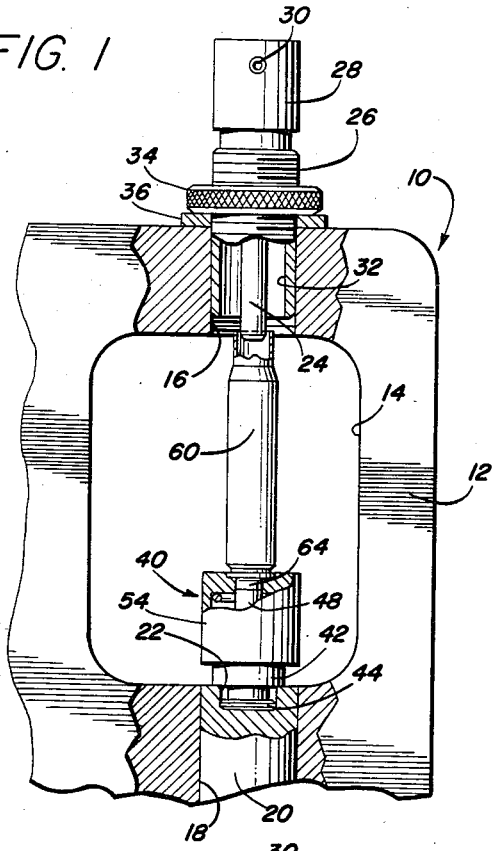
FIG. 1 is a side-elevational view of a reloading press frame, showing the present invention mounted thereon and wherein a cartridge case is positioned for primer reloading.
Figure 4:
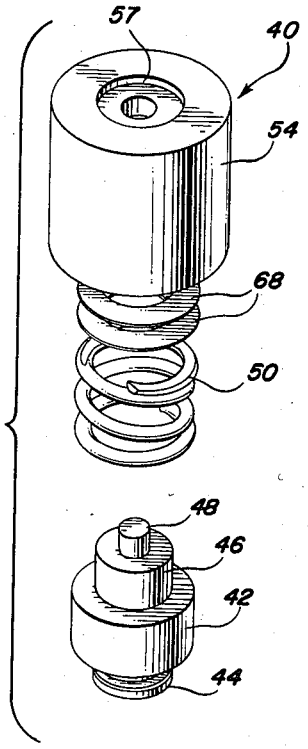
FIG. 4 is an exploded view of the primer-guide assembly.

Referring in more detail to the accompanying drawings, and more particularly to FIG. 1, there is shown a portion of a typical reloading press, generally indicated at 10, which is provided with a frame 12 defining an opening 14, the frame being formed with a threaded bore 16 aligned with a ram bore 18 in which a press ram 20 is positioned. The reloading device 10 is also provided with a leverage means (not shown) which, when activated, operates the press ram 20 so that it is raised upwardly towards threaded bore 16. The free end of press ram 20 includes a recess 22 which is arranged to recess the head of a shell.

Figure 2:
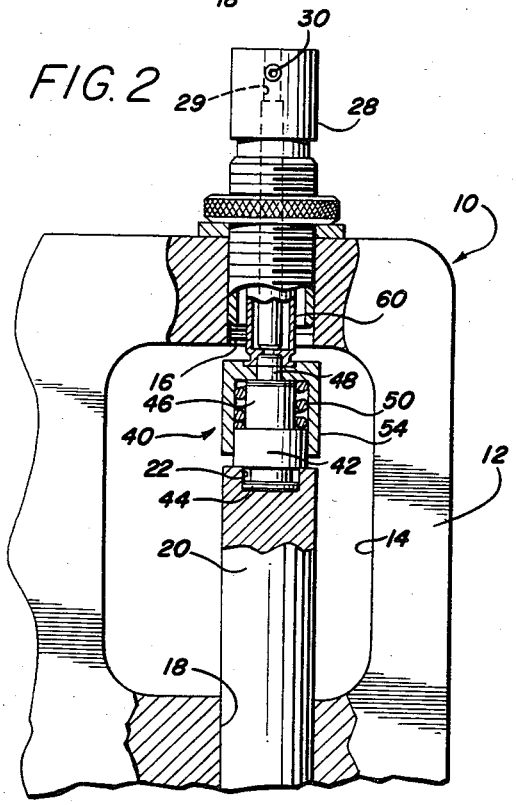
FIG. 2 is a similar side-elevational view, showing the primer being positioned within the primer pocket of the case.

Further illustrated in FIG. 1 is the present invention, a precision primer-reloading assembly, mounted in combination with the reloading device 10. The precision primer-reloading assembly comprises a ram rod 24 which is centrally located and mounted in an adjustable, tubular, support body 26. The lower portion of support body 26 is threaded so as to be received within the threaded bore 16 of the reloading frame member 14. The upper end of support body 26 is defined by a head member 28 which is formed with a central bore 29 adapted to receive one end of ram rod 24, as indicated in FIG. 2. Ram rod 24 has a reduced-diameter end which fits into bore 29 and is secured in place by screw 30. Thus, ram rod 24 is fixed so that it is centrally positioned within the enlarged bore 32 of tubular support body 26 and projects outwardly from bore 32. For best results, ram rod 24 should also project slightly below bore 16, as shown. In order to adjust ram rod 24 to its proper mounted position on frame 12, there is provided a lock-nut arrangement which includes lock nuts 34 and washer 36.

The present invention further includes a primer-guide assembly, generally indicated at 40, which comprises a guide-base member 42, the lower portion thereof being formed with a base head 44 adapted to be received in recess 22 of press ram 20. The opposite side of guide base member 42 is provided with a reduced-diameter neck member 46 and a primer-guide pin 48. A biasing means such as coil spring 50 is arranged to be positioned over neck member 46, so as to rest against shoulder 52 formed by guide base 42, as clearly seen in FIG. 3. A housing guide 54 is positioned over the base 42, whereby the bore 55 of housing guide 54 receives base 52, neck 46, guide pin 48 and spring 50. The closed end 56 of housing guide 54 is also provided with a circular recess 57 having an appropriate diameter to receive and support the primer head 58 of shell or case 60. A smaller bore 62 is centrally disposed in recess 57 and arranged to receive primer-guide pin 48.

When the present invention is mounted in a reloading device as described above, the following operation steps should be taken. One must first determine the correct depth for the primer 64 so that it is located below the primer head 58. It is important to note that the present device allows primer 64 to be located at a depth of between 0" and 0.010", using the flat surface of the primer head as zero. The depth of the primer pocket 65 must then be determined. This is done generally with a depth gauge instrument. Finally, the average height of the primer being used must be determined.

Figure 3:
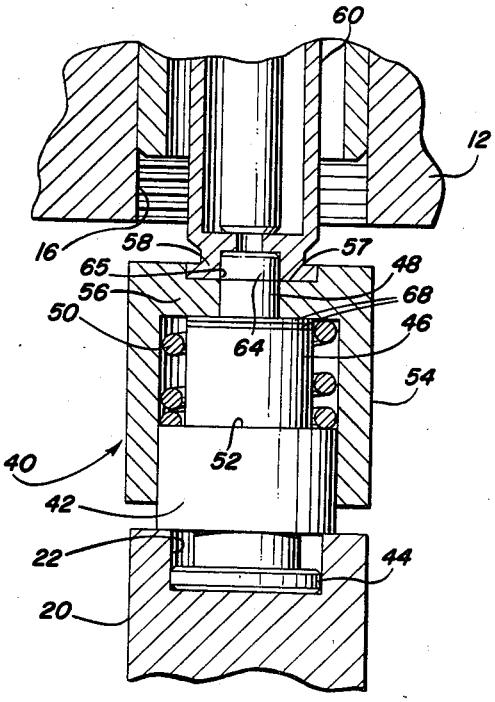
FIG. 3 is an enlarged cross-sectional view of the lower portion of the case supported by the guide housing, and the primer reloaded in its proper position.

After the above measurements are obtained, one can then determine the number of shims or spacers 68 necessary to compensate for the differences between the depth of the pocket and the primer. FIG. 3 illustrates two shims 68 positioned on neck member 46, thereby providing a short exposed length for primer pin 48. The arrangement, as shown in FIG. 3, positions primer 64 at a flat zero location with respect to the flat surface of the primer head 58. For example, if primer 64 is shorter than the depth of the primer pocket 65, one substracts the primer height from the pocket depth, then takes the difference and adds 0.002". This will be the distance that the primer is seated below the surface of the case head.

Unlike other priming tools, the present device uses the case head for the baseline or zero, so that consistent priming is possible. Thus, with the use of shims 68 various priming positions within the primer pocket of the primer head can be accomplished. Generally, there are no shims employed when the primer is to be seated at 0.010" below the case head. Each shim has a 0.002" thickness; therefore, as additional shims are used the primer will seat that much more below the case head. Accordingly, using one shim, the primer will be seated at 0.008" below the case head; and using two shims, the primer will be seated at 0.006", and so on. However, never more than five shims should be used, since that would result in the primer being seated flush.

The invention and its attendant advantages will be understood from the foregoing description; and it will be apparent that various changes may be made in the form, construction and arrangement of the parts of the invention without department from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A precision primer-reloading assembly which is mounted to and operated by a cartridge-reloading press, wherein the precision primer assembly comprises:

an adjustable support body mounted on the frame of a cartridge-reloading press;

a ram rod secured to said support body and depending downwardly therefrom;

means for adjustably mounting said support body to said frame;

a primer-guide assembly adapted to be mounted to a press ram which is operably mounted in said frame; said primer-guide assembly including:

a guide-base member having means formed on one end thereof for attaching said primer-guide assembly to said press ram;

a primer-guide pin formed on the opposite end of said guide-base member and adapted to engage and guide a primer into the primer pocket of a cartridge;

a housing guide formed to be slidably positioned over said guide base, said housing guide being defined by a tubular member having a closed end, said closed end including a centrally disposed hole formed therein to receive said primer-guide pin;

means formed in said housing guide to support said cartridge in a vertical position, said cartridge-support means comprising an annular recess formed in said closed end and aligned with said hold disposed therein, whereby the primer head of said cartridge is received in said recess and said primer pocket is aligned with said hole and said primer;

means for selectively positioning said primer in said primer pocket, said selective positioning means being located between said housing guide and said guide-base member, said selective-positioning means comprising at least one annular shim member located around said guide pin; and biasing means interposed between said guide-base member and said housing guide.

2. A precision primer-reloading assembly as recited in claim 1, wherein said attaching means of said guide-base member comprises an extended head member on the lower portion of said guide-base member, said extended head member being formed to be releasably mounted in a recess disposed in the end of said press ram.

3. A precision primer-reloading assembly as recited in claim 1, wherein said guide-base member includes a reduced-diameter neck member on which said primer-guide pin is formed, and wherein said neck member defines an annular shoulder to support one or more of said shim members.

4. A precision primer-reloading assembly as recited in claim 1, wherein said adjustable mounting means comprises:

threads being formed on said support body so as to be threaded within a threaded bore formed in said frame of said reloading press;

a nut threadably mounted to said support body; and a washer interposed between said nut and said frame.

* * * * *